US010295229B2

(12) United States Patent
Pal

(10) Patent No.: US 10,295,229 B2
(45) Date of Patent: May 21, 2019

(54) THERMOELECTRIC COOLING SYSTEM

(71) Applicant: HAMILTON SUNDSTRAND CORPORATION, Charlotte, NC (US)

(72) Inventor: Debabrata Pal, Hoffman Estates, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 170 days.

(21) Appl. No.: 14/858,577

(22) Filed: Sep. 18, 2015

(65) Prior Publication Data

US 2017/0082325 A1 Mar. 23, 2017

(51) Int. Cl.

| | |
|---|---|
| ***F25B 21/02*** | (2006.01) |
| ***H01L 35/00*** | (2006.01) |
| ***H01L 27/16*** | (2006.01) |
| ***H01L 37/00*** | (2006.01) |
| ***F25B 21/00*** | (2006.01) |
| ***H05K 7/20*** | (2006.01) |
| ***F28D 9/00*** | (2006.01) |
| ***F28F 3/00*** | (2006.01) |
| ***F28F 3/12*** | (2006.01) |

(52) U.S. Cl.

CPC ..... *F25B 21/02* (2013.01); *F25B 2321/0252* (2013.01)

(58) Field of Classification Search

CPC ..... F25B 21/02; F25B 21/04; F25B 2321/02; F25B 2321/0252; F28D 9/0081; F28F 3/00; F28F 3/12; H05K 7/20254; H05K 2201/10219

See application file for complete search history.

(56) References Cited

U.S. PATENT DOCUMENTS

| | | | | |
|---|---|---|---|---|
| 4,494,380 | A * | 1/1985 | Cross | F01N 3/00 62/3.2 |
| 6,191,945 | B1 | 2/2001 | Belady et al. | |
| 7,637,312 | B1 | 12/2009 | Heydari | |
| 8,522,861 | B2 | 9/2013 | Zaffetti et al. | |
| 8,584,738 | B2 | 11/2013 | Hurlbert et al. | |
| 8,804,337 | B2 | 8/2014 | Zaffetti et al. | |
| 2008/0087024 | A1 | 4/2008 | Hood et al. | |
| 2008/0267845 | A1* | 10/2008 | Hoglund | B01F 5/0451 422/224 |
| 2009/0249796 | A1* | 10/2009 | Ullman | F25B 21/02 62/3.7 |
| 2010/0071384 | A1* | 3/2010 | Lu | B60H 1/00592 62/3.2 |
| 2010/0253923 | A1* | 10/2010 | Yanagisawa | F28D 15/00 353/54 |
| 2012/0300402 | A1 | 11/2012 | Vos | |
| 2013/0223011 | A1 | 8/2013 | You et al. | |

(Continued)

*Primary Examiner* — Frantz Jules
*Assistant Examiner* — Erik Mendoza-Wilkenfe
(74) *Attorney, Agent, or Firm* — Cantor Colburn LLP

(57) ABSTRACT

A method and system to transfer heat using a cooling medium includes a first cold plate, including a first fluid flow path in thermal communication with a first thermal region of the first cold plate, and a second fluid flow path in fluid communication with the first fluid flow path and in thermal communication with a second thermal region of the first cold plate, and a thermoelectric heat exchanger in thermal communication with the first thermal region of the first cold plate.

17 Claims, 5 Drawing Sheets

(56) References Cited

U.S. PATENT DOCUMENTS

| | | | | |
|---|---|---|---|---|
| 2013/0285686 | A1* | 10/2013 | Malik | G01R 31/2875<br>324/750.05 |
| 2013/0291921 | A1* | 11/2013 | Morita | H01L 23/38<br>136/204 |
| 2013/0327369 | A1 | 12/2013 | Jovoic et al. | |

* cited by examiner

THERMOELECTRIC COOLING SYSTEM

BACKGROUND

The subject matter disclosed herein relates to cooling systems, and more particularly, to a system and a method for transferring heat using a thermoelectric heat exchanger.

Generators for use with turbine engines are integrated with constant speed drives to form an integrated drive generator. Electronic components for generator control are combined with the integrated drive generator in a common integrated packaging. Often, such integrated drive generator packages utilize common cooling circuits for the electronic control components and the integrated drive generator. The use of such common cooling circuits may prevent desired levels of heat transfer from the electronic components.

BRIEF SUMMARY

According to an embodiment, a system to transfer heat using a cooling medium includes a first cold plate, including a first fluid flow path in thermal communication with a first thermal region of the first cold plate, and a second fluid flow path in fluid communication with the first fluid flow path and in thermal communication with a second thermal region of the first cold plate, and a thermoelectric heat exchanger in thermal communication with the first thermal region of the first cold plate.

According to an embodiment, a method to transfer heat using a cooling medium includes providing a first cold plate, flowing the cooling medium through a first fluid flow path in thermal communication with a first thermal region of the first cold plate, flowing the cooling medium through a second fluid flow path from the first fluid flow path and in thermal communication with a second thermal region of the first cold plate, and transferring heat from the first thermal region of the first cold plate via a thermoelectric heat exchanger in thermal communication with the first thermal region of the first cold plate.

According to an embodiment, a system to transfer heat using a cooling medium includes a first cold plate, including a first fluid flow path in thermal communication with a first thermal region of the first cold plate, and a second fluid flow path in fluid communication with the first fluid flow path and in thermal communication with a second thermal region of the first cold plate, a thermoelectric heat exchanger in thermal communication with the first thermal region of the first cold plate, and a low temperature component in thermal communication with the second thermal region of the first cold plate.

Technical function of the embodiments described above includes a first cold plate, including a first fluid flow path in thermal communication with a first thermal region of the first cold plate and a thermoelectric heat exchanger in thermal communication with the first thermal region of the first cold plate.

Other aspects, features, and techniques of the embodiments will become more apparent from the following description taken in conjunction with the drawings.

BRIEF DESCRIPTION OF THE DRAWINGS

The subject matter is particularly pointed out and distinctly claimed in the claims at the conclusion of the specification. The foregoing and other features, and advantages of the embodiments are apparent from the following detailed description taken in conjunction with the accompanying drawings in which like elements are numbered alike in the FIGURES:

DETAILED DESCRIPTION

Figure 1:
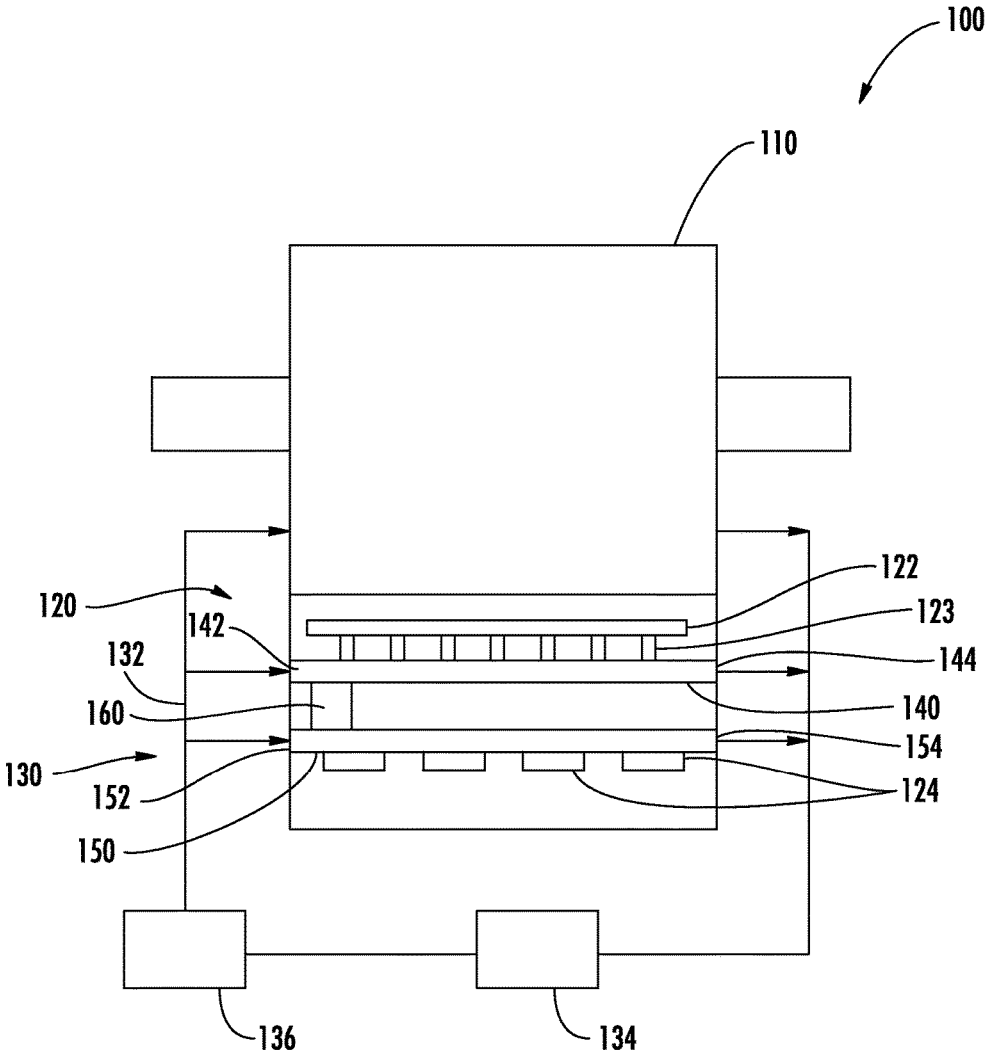
FIG. 1 is a schematic view of one embodiment of an integrated drive generator system.

Referring to the drawings, FIG. 1 shows an integrated drive generator system 100. In the illustrated embodiment, the integrated drive generator system 100 includes an integrated drive generator 110, an electronics package 120, and a cooling system generally referenced by numeral 130. In the illustrated embodiment, the integrated drive generator system 100 can provide generated power to an aircraft without requiring additional electronics other than those of the electronics package 120. In certain embodiments, the integrated drive generator system 100 can be located in an unpressurized and high temperature environment. Advantageously, the integrated drive generator system 100 can simplify the installation of a generation system and minimize system footprint.

In the illustrated embodiment, the integrated drive generator 110 can include any suitable generator for use with a turbine engine. The integrated drive generator 110 can be operatively connected to a turbine engine, the transmission of a turbine engine, etc. to generate electricity from the rotation of the turbine engine. During operation, the integrated drive generator 110 can produce a significant amount of heat, requiring external cooling. The integrated drive generator 110 can be cooled by the cooling system 130.

In the illustrated embodiment, the electronics package 120 can control and regulate the electricity produced by the integrated drive generator 110. Advantageously, in one embodiment, the electronics package 120 is integrated in the same housing as the integrated drive generator 110 to form the integrated drive generator system 100. In the illustrated embodiment, the electronics package 120 includes a generator control unit 122 and a plurality of converter regulators 124.

In the illustrated embodiment, the generator control unit 122 controls the functions and operations of the integrated drive generator 110. For example, the generator control unit 122 can control the excitation, speed, and output, etc. of the integrated drive generator 110. Compared to the integrated drive generator 110, the generator control unit 122 may require a lower operating temperature to ensure reliable operation. In certain embodiments, the maximum operating temperature of the generator control unit 122 is 105 degrees Celsius.

In the illustrated embodiment, the electronics package 120 can further include a plurality of converter regulators 124 to regulate the output of the integrated drive generator 110. The converter regulators 124 can be utilized to regulate the output voltage and current of the integrated drive generator 110. In certain embodiments, the converter regulators 124 are silicon carbide based power modules to allow high temperature operation.

In the illustrated embodiment, the components of the integrated drive generator system 100 are each cooled by the cooling system 130. In the illustrated embodiment, the cooling system includes a cooling circuit 132, an upper cold plate 140, a lower cold plate 150, and a supplemental heat exchanger 160. As illustrated, the cooling circuit 132 is connected in parallel to the integrated drive generator 110, the generator control unit 122 and the converter regulators 124. Advantageously, the use of a common cooling circuit 132 can reduce complexity and weight while effectively cooling the components of the integrated drive generator system 100. In the illustrated embodiment, the cooling circuit 132 is connected to the generator control unit 122 via an upper cooling plate 140 and to the converter regulators 124 via a lower cooling plate 150. In the illustrated embodiment, coolant within the cooling circuit 132 can be cooled and pumped via cooling/refrigeration components 134. In certain embodiments, the cooling system 130 can include other components 136 to be cooled.

During operation, the cooling system 130 can circulate coolant through the cooling circuit 132 to remove heat from the components of the integrated drive generator system 100. In the illustrated embodiment, the coolant can be any suitable cooling medium, such as a cooling oil, etc. During operation, the cooling oil inlet temperature to the integrated drive generator 110 is approximately 85 degrees Celsius with a short term maximum of 115 degrees Celsius. The integrated drive generator 110 can utilize the cooling circuit 132 to remove heat from the integrated drive generator 110. In certain embodiments, the temperature of the coolant within the cooling circuit 132 is not low enough to adequately cool the generator control unit 122. Therefore, it is desired to operate and cool the generator control unit 122 to a cooler temperature to increase reliability and reduce mean time between failures. In the illustrated embodiment, the use of the upper cooling plate 140 along with the supplemental heat exchanger 160 can precool the coolant of the cooling circuit 132 to reduce coolant temperatures by up to 30 degrees Celsius, without requiring a separate cooling system for the generator control unit 122.

Figure 2:
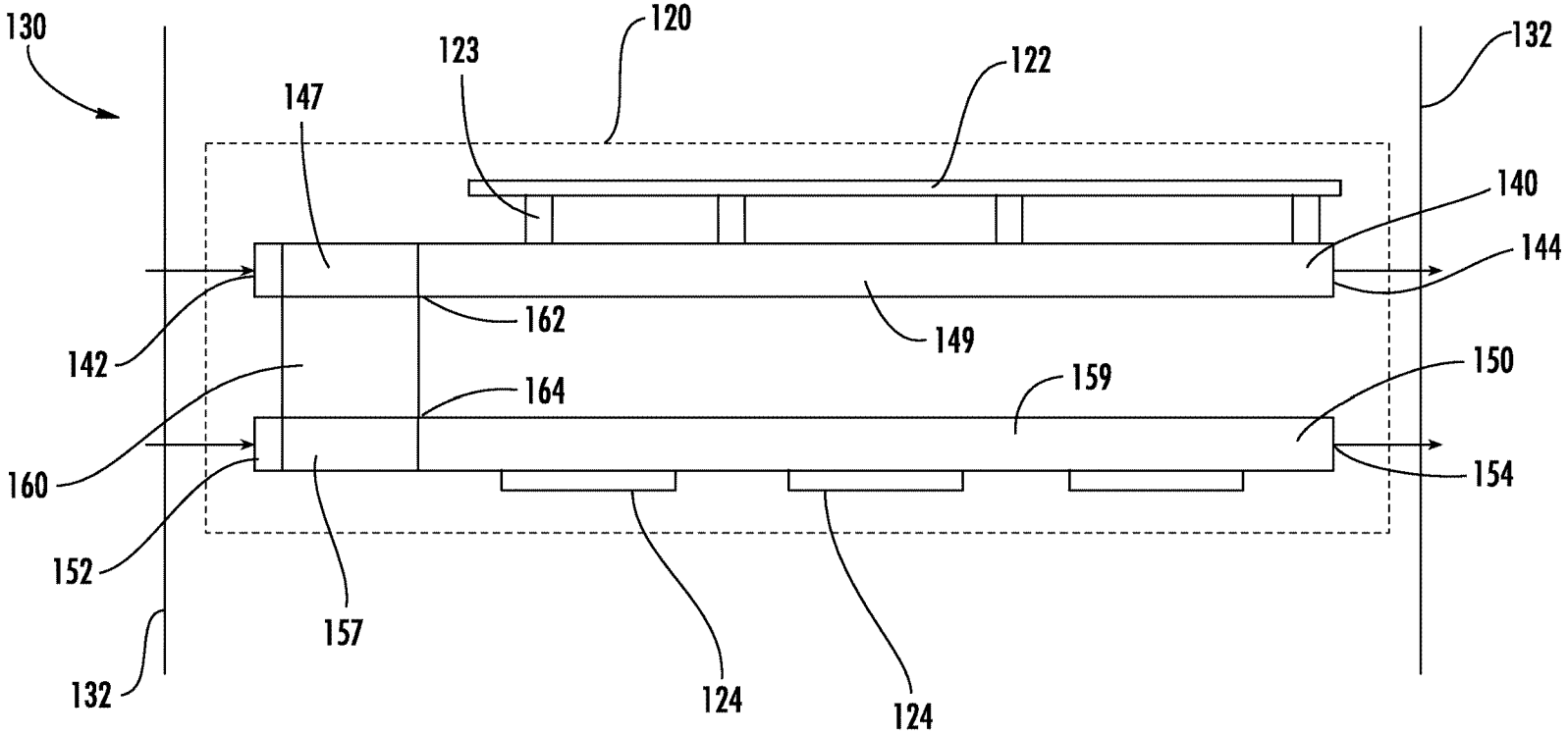
FIG. 2 is a schematic view of one embodiment of a cooling system for use with the integrated drive generator system of FIG. 1.
Figure 3:
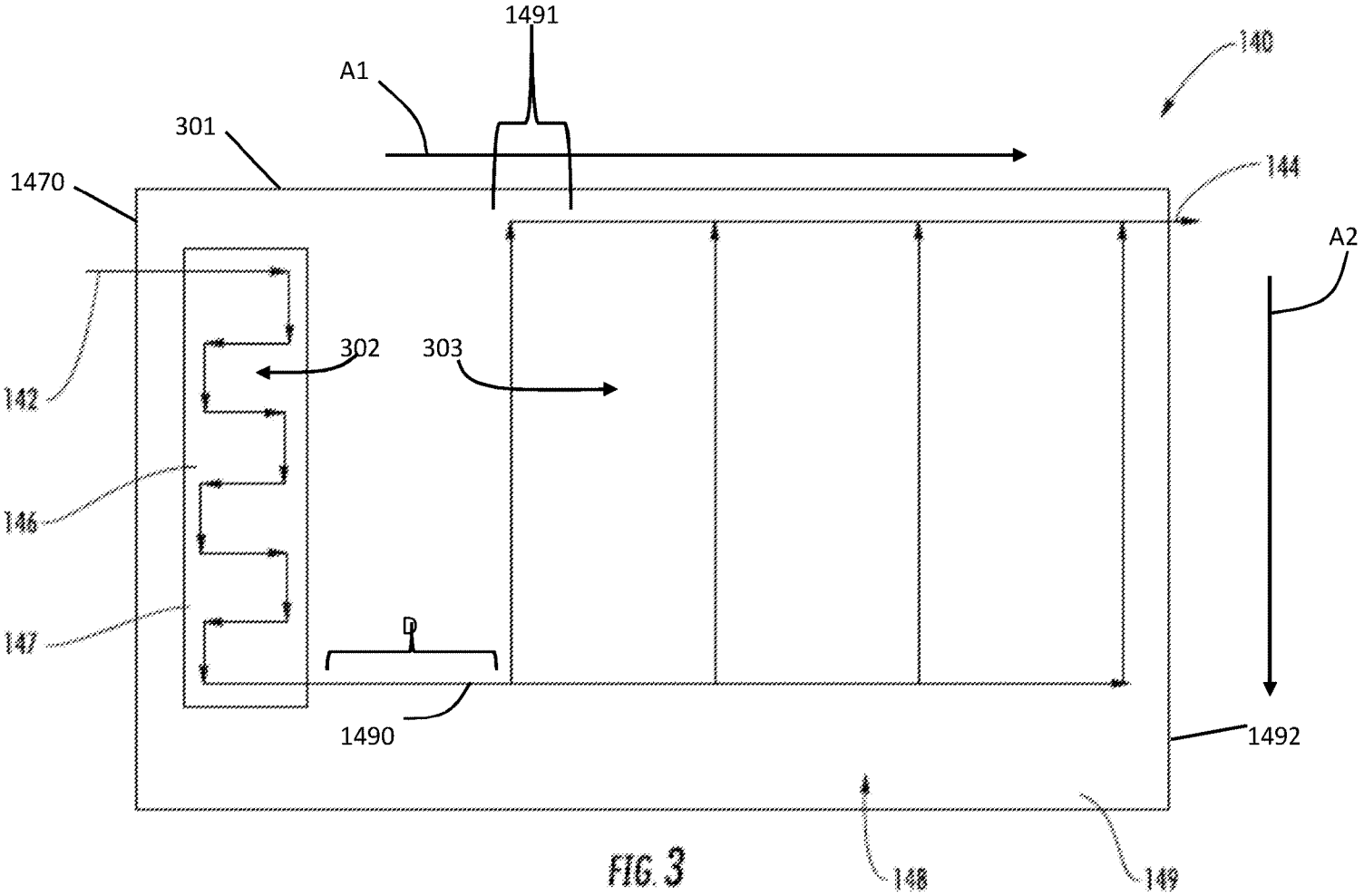
FIG. 3 is a schematic view of one embodiment of an upper cold plate of the cooling system of FIG. 2.

Referring to FIGS. 2 and 3, an upper cold plate 140 is shown. In the illustrated embodiment, the upper cold plate 140 includes an inlet 142, an outlet 144, a first flow path 146, a first thermal region 147, a second flow path 148 and a second thermal region 149. The first and second thermal regions 147 and 149 are arranged along a first longitudinal axis A1, which extends in parallel with a long edge 301 of the upper cold plate 140. The first thermal region 147 is concentrated proximate to a first short edge 1470 of the upper cold plate 140. The second thermal region 149 is displaced (i.e., positioned at a distance D) from the first thermal region 147 along a length of a single straight fluid flow line 1490 that is connected at opposite ends thereof to the first flow path 146 and the second flow path 148, respectively, such that the single straight fluid flow line 1490 is fluidly interposed between the first flow path 146 and the second flow path 148. The second thermal region 149 is distributed from a central portion 1491 of the upper cold plate 140 at an end of the single straight line 1490 and toward a second short edge 1492 of the upper cold plate 140, which is opposite the first short edge 1470. The central portion 1491 is defined between the first and second short edges 1470 and 1492. As best shown in FIG. 2, the generator control unit 122 can be coupled to the upper cold plate 140 via mounting bosses or standoffs 123. In the illustrated embodiment, the generator control unit 122 can be structurally and thermally coupled to the upper cold plate 140.

In the illustrated embodiment, the upper cold plate 140 can receive a coolant flow from the cooling circuit 132 via the inlet 142. Depending on cooling demands, the flow rate of coolant through the upper cold plate 140 can be varied. In the illustrated embodiment, the generator control unit 122 is expected to produce 20 watts of heat to be dissipated, requiring a flow rate of approximately 0.08 lbm/minute. In the illustrated embodiment, the coolant can flow through the upper cold plate 140 from the inlet 142 to the outlet 144.

In the illustrated embodiment, the coolant can flow from the inlet 142 through the first flow path 146 which is in thermal communication with the first thermal region 147. The first flow path 146 is contained within a space 302 defined within the first thermal region 147 and can be a tortuous flow path that extends along a second axis A2 which is transversely oriented relative to the first longitudinal axis A1 to maximize surface area and residence time in the first thermal region 147 to maximize heat transfer between the fluid within the first flow path 146 and the first thermal region 147. As best shown in FIG. 2 the first thermal region 147 is in thermal communication with the supplemental heat exchanger 160. In the illustrated embodiment, the supplemental heat exchanger 160 can receive and transfer heat from the first flow path 146 via the first thermal region 147 to remove heat from the coolant.

In the illustrated embodiment, the cooled coolant can flow from the outlet of the first flow path 146 into the second flow path 148. The second flow path can be contained within a space 303 defined within the second thermal region 149 and can include a plurality of parallel flow paths which are arranged in a side-by-side formation along the first longitudinal axis A1 and which extend along the second axis A2 to maximize thermal communication with the second thermal region 149. In the illustrated embodiment, the second thermal region 149 is in thermal communication with the generator control unit 122 to remove heat from the generator control unit 122. In the illustrated embodiment, the coolant flow can exit the upper cold plate 140 via the outlet 144. Advantageously, the coolant with supplemental cooling can remove the desired amount heat from the generator control unit 122 to ensure reliability.

Figure 4:
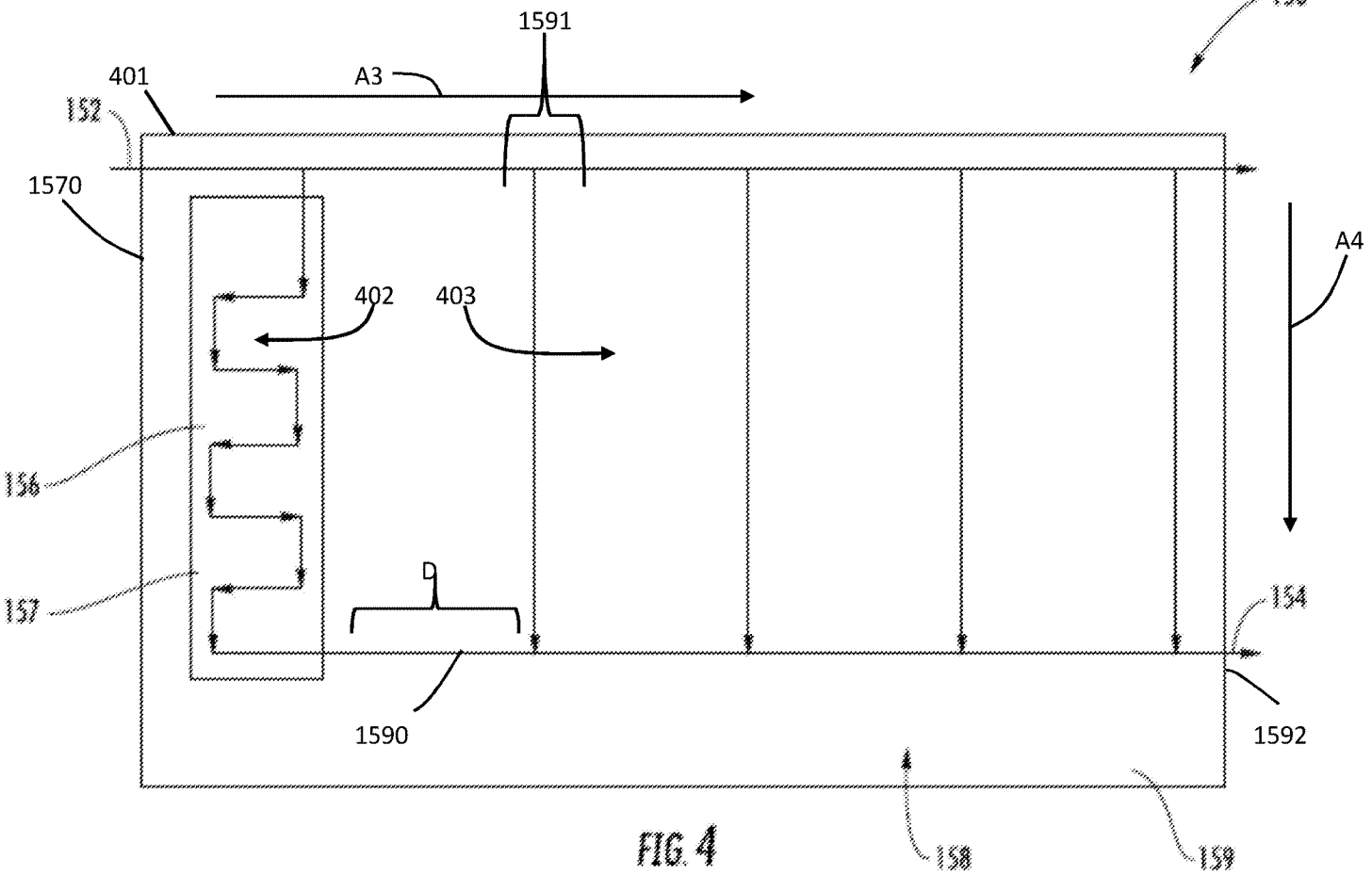
FIG. 4 is a schematic view of one embodiment of a lower cold plate of the cooling system of FIG. 2.

Referring to FIGS. 2 and 4, a lower cold plate 150 is shown. In the illustrated embodiment, the lower cold plate 150 includes an inlet 152, an outlet 154, a third flow path 156, a third thermal region 157, a fourth flow path 158 and a fourth thermal region 159. The third and fourth thermal regions 157 and 159 are arranged along a third longitudinal axis A3, which extends in parallel with a long edge 401 of the lower cold plate 150. The third thermal region 157 is concentrated proximate to a first short edge 1570 of the lower cold plate 150. The fourth thermal region 159 is displaced (i.e., positioned at a distance D) from the third thermal region 157 along a length of a single straight fluid flow line 1590 that is connected at opposite ends thereof to the third flow path 156 and the fourth flow path 158, respectively, such that the single straight fluid flow line 1590 is fluidly interposed between the third flow path 156 and the fourth flow path 158. The second thermal region 159 is distributed from a central portion 1591 of the lower cold plate 150 at an end of the single straight line 1590 and toward a second short edge 1592 of the lower cold plate 150, which is opposite the first short edge 1570. The central portion 1591 is defined between the first and second short edges 1570 and 1592. As best shown in FIG. 2, the converter regulators 124 structurally and thermally coupled to the lower cold plate 150. Further, as also best shown in FIG. 2, the lower cold plate 150 is connected to the cooling circuit 132 in parallel to the upper cold plate 140.

In the illustrated embodiment, the lower cold plate 150 can receive a coolant flow from the cooling circuit 132 via the inlet 152. Depending on cooling demands, the flow rate of coolant through the lower cold plate 150 can be varied. In the illustrated embodiment, the converter regulators 124 are expected to produce approximately 1000 watts of heat to be dissipated, requiring a flow rate of approximately 4.00 lbm/minute. In the illustrated embodiment, the coolant can flow through the lower cold plate 150 from the inlet 152 to the outlet 154.

In the illustrated embodiment, the coolant can flow form the inlet 152 through the third flow path 156 which is in thermal communication with the third thermal region 157. The third flow path 156 is contained within a space 402 defined within the third thermal region 157 and can be a tortuous flow path that extends along a fourth axis A4 which is transversely oriented relative to the third longitudinal axis A3 to maximize surface area and residence time in the third thermal region 157 to maximize heat transfer between the fluid within the third flow path 156 and the third thermal region 157. As best shown in FIG. 2, the third thermal region 157 is in thermal communication with the supplemental heat exchanger 160. In the illustrated embodiment, the heat exchanger 150 can transfer heat from the upper cold plate 140 to the third flow path 156 via the third thermal region 157 to introduce heat to the coolant within the third flow path 156.

In the illustrated embodiment, the fourth flow path 158 is a flow path parallel to the third flow path 156. The fourth flow path 158 can be contained within a space 403 defined within the fourth thermal region 159 and can include a plurality of parallel flow paths which are arranged in a side-by-side formation along the third longitudinal axis A3 and which extend along the fourth axis A4 to maximize thermal communication with the fourth thermal region 159. In the illustrated embodiment, the fourth thermal region 159 is in thermal communication with the converter regulators 124 to remove heat from the converter regulators 124. In the illustrated embodiment, the coolant flow can exit the lower cold plate 150 via the outlet 154.

In the illustrated embodiment, the supplemental heat exchanger 160 is in thermal communication with both the upper cold plate 140 and the lower cold plate 150. In the illustrated embodiment, the cold side 162 removes heat from the upper cold plate 140 and the hot side 164 transfers heat to the lower cold plate 150. In the illustrated embodiment, the supplemental heat exchanger 160 is a thermoelectric module. Advantageously, the supplemental heat exchanger 160 can remove heat from the coolant in the first flow path 146 to provide pre-cooled coolant at temperature lower than the coolant provided by the cooling circuit 132 alone. In the illustrated embodiment, the supplemental heat exchanger 160 can reduce coolant temperatures from approximately 71 degrees Celsius to approximately 40 degrees Celsius.

Figure 5:
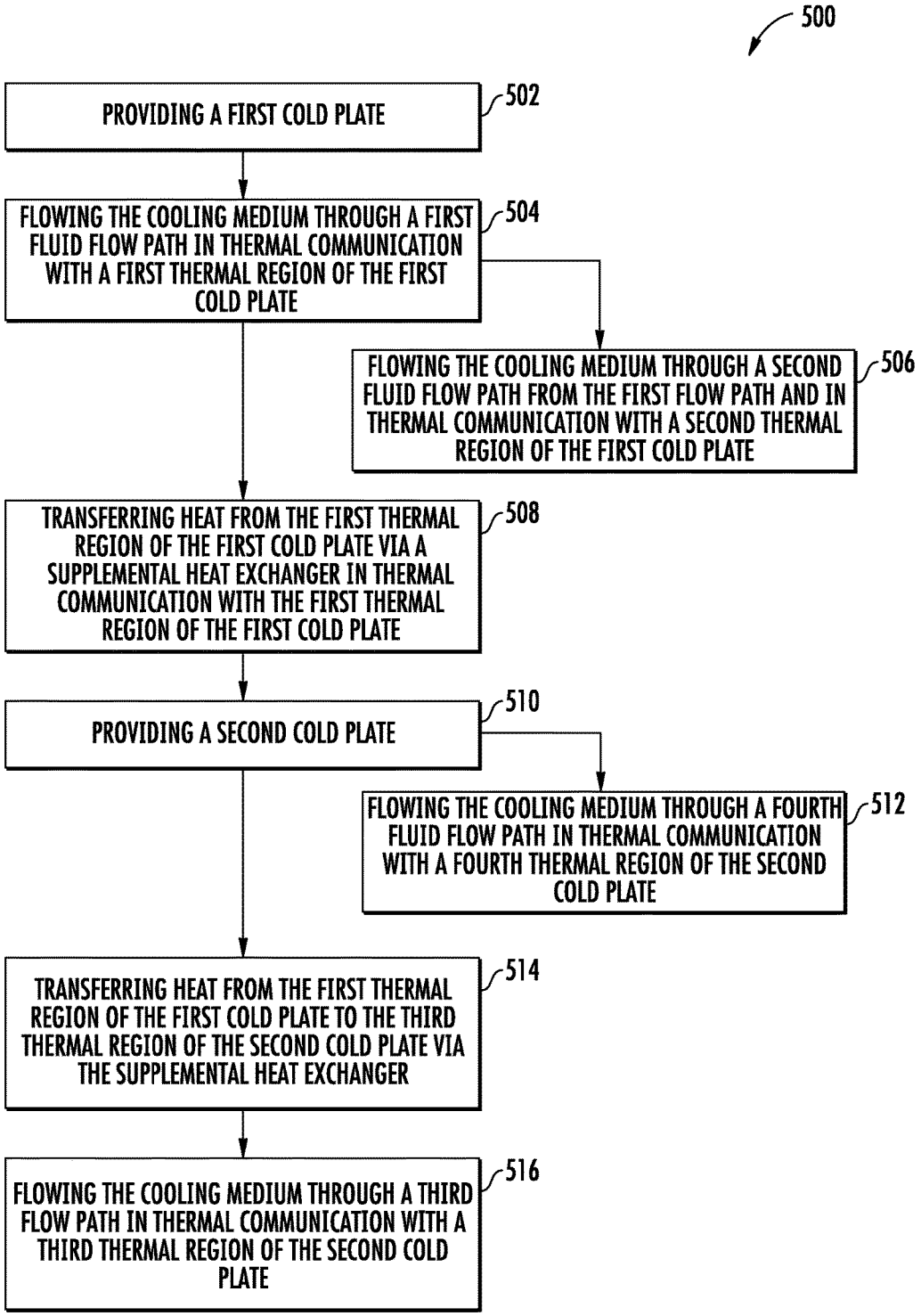
FIG. 5 is a flow chart of one embodiment of a method to transfer heat using a cooling medium.

Referring to FIG. 5, a method 500 for transferring heat using a cooling medium is shown. In operation 502 a first or upper cold plate is provided. In certain embodiments, a generator control unit can be coupled to the upper cold plate via mounting bosses or standoffs. In the illustrated embodiment, the generator control unit can be structurally and thermally coupled to the upper cold plate.

In operation 504, the cooling medium is flowed through a first fluid flow path in thermal communication with a first thermal region of the first cold plate. The first flow path can be a tortuous flow path to maximize surface area and residence time in the first thermal region to maximize heat transfer between the fluid within the first flow path and the first thermal region.

In operation 506, the cooling medium is flowed through a second fluid flow path from the first fluid flow path and in thermal communication with a second thermal region of the first cold plate. The second flow path can include a plurality of parallel flow paths to maximize thermal communication with the second thermal region. In the illustrated embodiment, the second thermal region is in thermal communication with the generator control unit to remove heat from the generator control unit.

In operation 508, heat from the first thermal region of the first cold plate is transferred via a supplemental heat exchanger in thermal communication with the first thermal region of the first cold plate. In the illustrated embodiment, the supplemental heat exchanger can receive and transfer heat from the first flow path via the first thermal region to remove heat from the cooling medium.

In operation 510, a second cold plate is provided. In certain embodiments, converter regulators are structurally and thermally coupled to the second or lower cold plate. In certain embodiments, the lower cold plate is connected to a cooling circuit in parallel to the upper cold plate.

In operation 512, cooling medium is flowed through a fourth fluid flow path in thermal communication with a fourth thermal region of the second cold plate. The fourth flow path can include a plurality of parallel flow paths to maximize thermal communication with the fourth thermal region. In the illustrated embodiment, the fourth thermal region is in thermal communication with the converter regulators to remove heat from the converter regulators.

In operation 514, heat from the first thermal region of the first cold plate is transferred to the third thermal region of the second cold plate via the supplemental heat exchanger. Advantageously, the supplemental heat exchanger can remove heat from the coolant in the first flow path to provide pre-cooled coolant at temperature lower than the coolant provided by the cooling circuit alone.

In operation 516, the cooling medium is flowed through a third flow path in thermal communication with a third thermal region of the second cold plate. The third flow path can be a tortuous flow path to maximize surface area and residence time in the third thermal region to maximize heat transfer between the fluid within the third flow path and the third thermal region.

The terminology used herein is for the purpose of describing particular embodiments only and is not intended to be limiting of the embodiments. While the description of the present embodiments has been presented for purposes of illustration and description, it is not intended to be exhaustive or limited to the embodiments in the form disclosed. Many modifications, variations, alterations, substitutions or equivalent arrangement not hereto described will be apparent to those of ordinary skill in the art without departing from the scope and spirit of the embodiments. Additionally, while various embodiments have been described, it is to be understood that aspects may include only some of the described embodiments. Accordingly, the embodiments are not to be seen as limited by the foregoing description, but are only limited by the scope of the appended claims.

What is claimed is:

1. A system to transfer heat using a cooling medium, comprising:

a first plate, including:

a first fluid flow path in thermal communication with a first thermal region of the first plate; and a second fluid flow path in fluid communication with the first fluid flow path and in thermal communication with a second thermal region of the first plate, wherein the first and second thermal regions are arranged along a first longitudinal axis of the first plate, which extends in parallel with a long edge of the first plate, with the first thermal region concentrated proximate to a first short edge of the first plate and with the second thermal region being:

positioned at a distance from the first thermal region along a length of a single straight fluid flow line, which is connected at opposite ends thereof to the first and second flow paths, respectively, such that the single straight fluid flow line is fluidly interposed between the first and second fluid flow paths, and distributed from a central portion of the first plate toward a second short edge of the first plate, which is opposite the first short edge, the central portion of the first plate being defined between the first and second short edges, and wherein the first fluid flow path is contained within a space defined within the first thermal region and extends tortuously along a second axis, which is transversely oriented relative to the first longitudinal axis, and the second fluid flow path is contained within the second thermal region and comprises parallel lines, which are arranged in a side-by-side formation along the first longitudinal axis and which extend along the second axis; and a thermoelectric heat exchanger having one side that is disposed to abut only the first thermal region of the first plate so as to be in direct thermal communication with only the first thermal region of the first plate.

2. The system of claim 1, wherein the first fluid flow path is in fluid communication with a first plate inlet and the second fluid flow path is in fluid communication with a first fluid flow path outlet and a first plate outlet.

3. The system of claim 1, further comprising a second plate including third and fourth thermal regions, a second side of the thermoelectric heat exchanger, which is opposite the one side of the thermoelectric heat exchanger, being disposed to abut only the third thermal region so as to be in direct thermal communication with only the third thermal region.

4. The system of claim 3, the second plate including:

a third fluid flow path in thermal communication with the third thermal region of the second plate, wherein the third thermal region of the second plate is in direct thermal communication with the thermoelectric heat exchanger.

5. The system of claim 4, wherein:

wherein the third and fourth thermal regions are arranged along a second longitudinal axis of the second plate, which extends in parallel with a long edge of the second plate, with the third thermal region concentrated proximate to a first short edge of the second plate and with the fourth thermal region being:

positioned at a distance from the third thermal region along a length of a single straight fluid flow line, which is connected at opposite ends thereof to the third fluid flow path and a fourth fluid flow path, respectively, such that the single straight fluid flow line is fluidly interposed between the third fluid flow path and the fourth fluid flow path, and distributed from a central portion of the second plate toward a second short edge of the second plate, which is opposite the first short edge, the central portion of the second plate being defined between the first and second short edges and wherein:

the third fluid flow path is contained within a space defined within the third thermal region and extends tortuously along a fourth axis, which is transversely oriented relative to the second longitudinal axis, and the second plate further comprises the fourth fluid flow path, which is contained within the fourth thermal region and comprises parallel lines, which are arranged in a side-by-side formation along the second longitudinal axis and which extend along the fourth axis, and is in thermal communication with the fourth thermal region of the second plate.

6. The system of claim 5, wherein the third fluid flow path is in fluid communication with a second plate inlet and a second plate outlet and the fourth fluid flow path is in fluid communication with the second plate inlet and the second plate outlet.

7. The system of claim 3, wherein the first plate and the second plate are in fluid communication.

8. A method to transfer heat using a cooling medium, comprising:

providing a first plate with first and second thermal regions;

flowing the cooling medium through a first fluid flow path in thermal communication with the first thermal region;

flowing the cooling medium through a second fluid flow path from the first fluid flow path and in thermal communication with the second thermal region, wherein the first and second thermal regions are arranged along a first longitudinal axis of the first plate, which extends in parallel with a long edge of the first plate, with the first thermal region concentrated proximate to a first short edge of the first plate and with the second thermal region being:

positioned at a distance from the first thermal region along a length of a single straight fluid flow line, which is connected at opposite ends thereof to the first and second fluid flow paths, respectively, such that the single straight fluid flow line is fluidly interposed between the first and second fluid flow paths, and distributed from a central portion of the first plate toward a second short edge of the first plate, which is opposite the first short edge, the central portion of the first plate being defined between the first and second short edges, and wherein the first fluid flow path is contained within a space defined within the first thermal region and extends tortuously along a second axis, which is transversely oriented relative to the first longitudinal axis, and the second fluid flow path is contained within the second thermal region and comprises parallel lines, which are arranged in a side-by-side formation along the first longitudinal axis and which extend along the second axis;

disposing one side of a thermoelectric heat exchanger in abutment with only the first thermal region of the first plate so as to be in direct thermal communication with only the first region; and transferring heat from the first thermal region of the first plate to the thermoelectric heat exchanger.

9. The method of claim 8, further comprising:

providing a second plate with third and fourth thermal regions;

disposing a second side of the thermoelectric heat exchanger, which is opposite the one side of the thermoelectric heat exchanger, in abutment with only the third thermal region of the second plate so as to be in direct thermal communication with only the third thermal region; and transferring heat from the first thermal region of the first plate to the third thermal region of the second plate via the thermoelectric heat exchanger.

10. The method of claim 9, further comprising:

flowing the cooling medium through a third flow path in direct thermal communication with the third thermal region of the second plate.

11. The method of claim 10, wherein:

wherein the third and fourth thermal regions are arranged along a second longitudinal axis of the second plate, which extends in parallel with a long edge of the second plate, with the third thermal region concentrated proximate to a first short edge of the second plate and with the fourth thermal region being:

positioned at a distance from the third thermal region along a length of a single straight fluid flow line, which is connected at opposite ends thereof to the third fluid flow path and a fourth fluid flow path, respectively, such that the single straight fluid flow line is fluidly interposed between the third fluid flow path and the fourth fluid flow path, and distributed from a central portion of the second plate toward a second short edge of the second plate, which is opposite the first short edge, the central portion of the second plate being defined between the first and second short edges and wherein:

the third fluid flow path is contained within a space defined within the third thermal region and extends tortuously along a fourth axis, which is transversely oriented relative to the second longitudinal axis, and the method further comprises flowing the cooling medium through the fourth fluid flow path, which is contained within the fourth thermal region and comprises parallel lines, which are arranged in a side-by-side formation along the second longitudinal axis and which extend along the fourth axis, and is in thermal communication with the fourth thermal region of the second plate.

12. The method of claim 9, wherein the first plate and the second plate are in fluid communication.

13. A system to transfer heat using a cooling medium, comprising:

a first plate, including:

a first fluid flow path in thermal communication with a first thermal region of the first plate; and a second fluid flow path in fluid communication with the first fluid flow path and in thermal communication with a second thermal region of the first plate, wherein the first and second thermal regions are arranged along a first longitudinal axis of the first plate, which extends in parallel with a long edge of the first plate, with the first thermal region concentrated proximate to a first short edge of the first plate and with the second thermal region being:

positioned at a distance from the first thermal region along a length of a single straight fluid flow line, which is connected at opposite ends thereof to the first and second flow paths, respectively, such that the single straight fluid flow line is fluidly interposed between the first and second fluid flow paths, and distributed from a central portion of the first plate toward a second short edge of the first plate, which is opposite the first short edge, the central portion of the first plate being defined between the first and second short edges, and wherein the first fluid flow path is contained within a space defined within the first thermal region and extends tortuously along a second axis, which is transversely oriented relative to the first longitudinal axis, and the second fluid flow path is contained within the second thermal region and comprises parallel lines, which are arranged in a side-by-side formation along the first longitudinal axis and which extend along the second axis;

a thermoelectric heat exchanger having one side in thermal communication with only the first thermal region of the first plate; and a first component in thermal communication with only the second thermal region of the first plate.

14. The system of claim 13, further comprising a second plate including third and fourth thermal regions, a second side of the thermoelectric heat exchanger, which is opposite the first side of the thermoelectric heat exchanger, being disposed in thermal communication with only the third thermal region.

15. The system of claim 14, the system further comprising:

a second component in thermal communication with the second plate, the second plate including:

a third fluid flow path in thermal communication with the third thermal region of the second plate, wherein the third thermal region of the second plate is in direct thermal communication with the thermoelectric heat exchanger; and a fourth fluid flow path in thermal communication with the fourth thermal region of the second plate, wherein the third and fourth thermal regions are arranged along a second longitudinal axis of the second plate, which extends in parallel with a long edge of the second plate, with the third thermal region concentrated proximate to a first short edge of the second plate and with the fourth thermal region being:

positioned at a distance from the third thermal region along a length of a single straight fluid flow line, which is connected at opposite ends thereof to the third fluid flow path and a fourth fluid flow path, respectively, such that the single straight fluid flow line is fluidly interposed between the third fluid flow path and the fourth fluid flow path, and distributed from a central portion of the second plate toward a second short edge of the second plate, which is opposite the first short edge, the central portion of the second plate being defined between the first and second short edges and wherein:

the third fluid flow path is contained within a space defined within the third thermal region and extends tortuously along a fourth axis, which is transversely oriented relative to the second longitudinal axis, and the fourth fluid flow path is contained within the fourth thermal region and comprises parallel lines, which are arranged in a side-by-side formation along the second longitudinal axis and which extend along the fourth axis, and the second component is in thermal communication with the fourth thermal region of the second plate.

16. The system of claim 13, wherein the first component is a generator control unit.

17. The system of claim 14, wherein the second component is a converter regulator.

* * * * *